United States Patent [19]

Lingenfelser

[11] 4,213,592

[45] Jul. 22, 1980

[54] BRACKET ASSEMBLY FOR MOUNTING FIRE EXTINGUISHERS THEREON

[75] Inventor: Daniel J. Lingenfelser, Peoria, Ill.

[73] Assignee: Caterpillar Tractor Co., Peoria, Ill.

[21] Appl. No.: 918,232

[22] Filed: Jun. 23, 1978

[51] Int. Cl.[2] ..... A47K 1/08

[52] U.S. Cl. ..... 248/313; 211/88

[58] Field of Search ..... 248/309, 316 B, 310, 248/311, 311.1, 313; 211/88, 71; 24/248 A, 248 B; 224/5 W

[56] References Cited

U.S. PATENT DOCUMENTS

| | | | |
|---|---|---|---|
| 1,806,516 | 5/1931 | Bardsley | 248/313 |
| 2,945,664 | 7/1960 | Zimmer | 248/316 R |
| 3,105,594 | 10/1963 | Ewers | 248/313 X |
| 3,316,040 | 4/1967 | McGann | 248/311.1 X |
| 3,565,384 | 2/1971 | Lockwood | 211/88 X |
| 3,643,813 | 2/1972 | Noonan | 248/313 X |
| 3,648,830 | 3/1972 | Graf | 248/311.1 X |
| 3,765,636 | 10/1973 | Burrell et al. | 248/313 |
| 3,780,972 | 12/1973 | Brodersen | 248/313 |
| 4,023,761 | 5/1977 | Mohs | 248/313 |

*Primary Examiner*—J. Franklin Foss

*Attorney, Agent, or Firm*—Phillips, Moore, Weissenberger, Lempio & Majestic

[57] ABSTRACT

A tubular article (F), such as a fire extinguisher, is normally retained on a bracket (10) by a releasable latch mechanism (19). An elastomeric pad (26) is compressed between an upper end of the article and the bracket for ejecting the article outwardly from the bracket upon release of the latch mechanism. A lower end (R) of the article is retained on the bracket by a lug (28) which releases the article for forward pivoting movement upon ejection thereof from the bracket.

5 Claims, 4 Drawing Figures

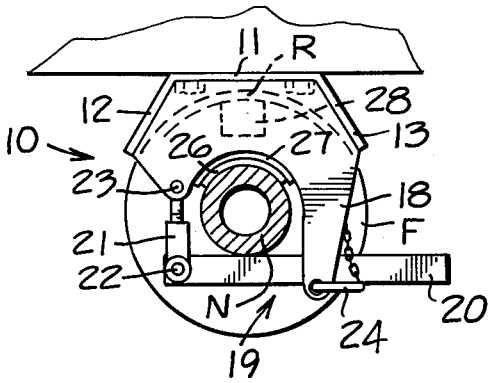
FIGURE 3.
FIGURE 2.
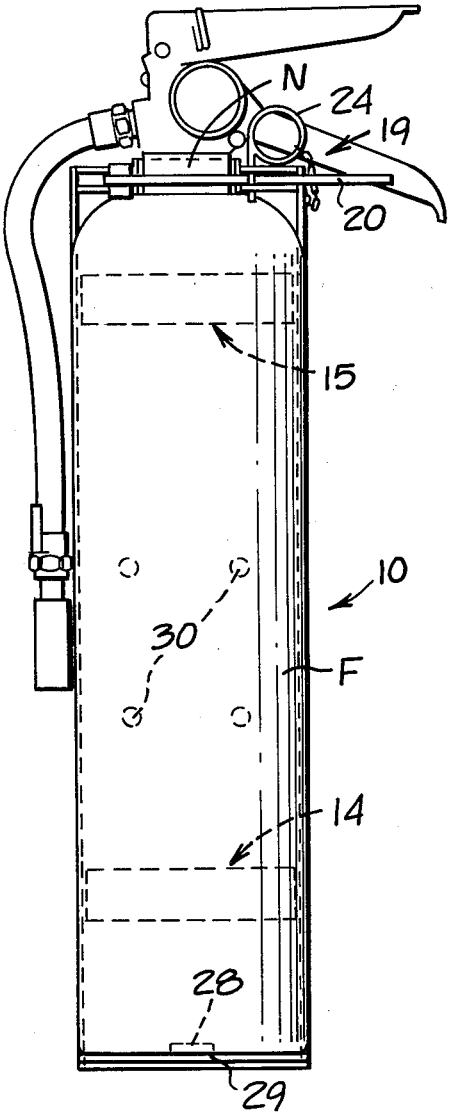
FIGURE 4.
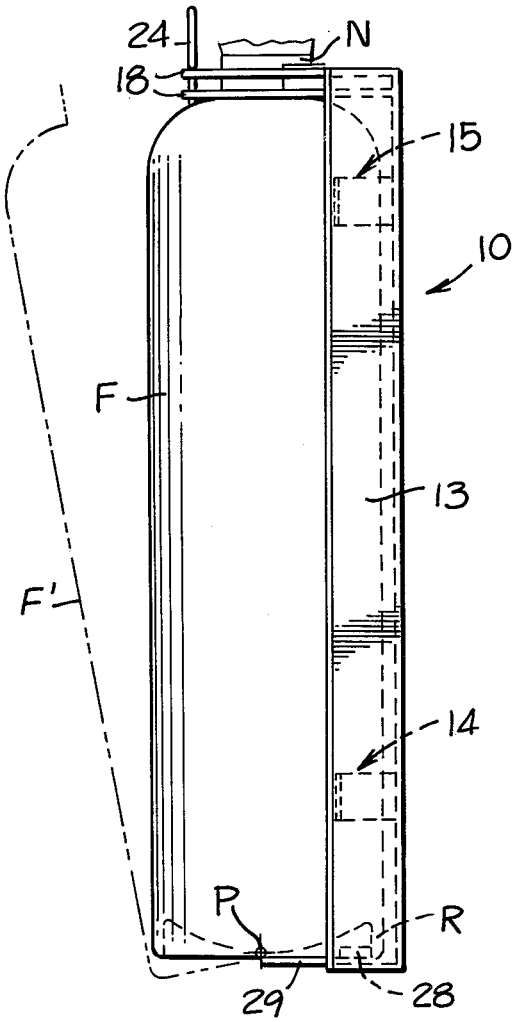

BRACKET ASSEMBLY FOR MOUNTING FIRE EXTINGUISHERS THEREON

TECHNICAL FIELD

This invention relates to a bracket assembly adapted for mounting in a construction vehicle or the like for retaining a fire extinguisher thereon and which is adapted to expeditiously release and eject the fire extinguisher for use purposes.

BACKGROUND ART

A standard bracket assembly for mounting a tank-type fire extinguisher thereon normally comprises a clamping mechanism for releasing the fire extinguisher should the need arise. Bracket assemblies and clamping mechanisms of this type may exhibit the tendency to permit the fire extinguisher to become disloged inadvertently from the bracket assembly during operation of a vehicle on which it is mounted. In addition, such bracket assemblies do not provide means for ejecting fire extinguishers therefrom for ready use by the operator of the vehicle.

DISCLOSURE OF THE INVENTION

The present invention is directed to overcoming one or more of the problems as set forth above.

The bracket assembly of this invention comprises a bracket defining a mounting recess therein adapted to have the article at least partially disposed therein and latch means having a lever pivotally mounted on the bracket for retaining the article in position thereon. A kick-out means, including an elastomeric pad having a circumferential length substantially less than 180°, automatically ejects the article outwardly from the bracket upon release of the latch means. A retaining means for retaining a lower end of the article on the bracket includes a lug secured to a botton plate of the bracket and separated from a back plate thereof to provide a space for the reception of a rim of an article therein.

A non-complex and economical bracket assembly is thus provided for securely mounting a tubular article, such as a tank-type fire extinguisher, thereon and for permitting expenditious ejection of the article from the bracket assembly.

BRIEF DESCRIPTION OF THE DRAWINGS

Other objects of this invention will become apparent from the following description and accompanying drawings wherein.

FIG. 2 is a front elevational view of the bracket assembly having a tank-type fire extinguisher mounted thereon;

FIG. 3 is a top plan view of the bracket assembly and fire extinguisher; and

FIG. 4 is a side elevational view of the bracket assembly and fire extinguisher.

BEST MODE FOR CARRYING OUT THE INVENTION

Figure 1:
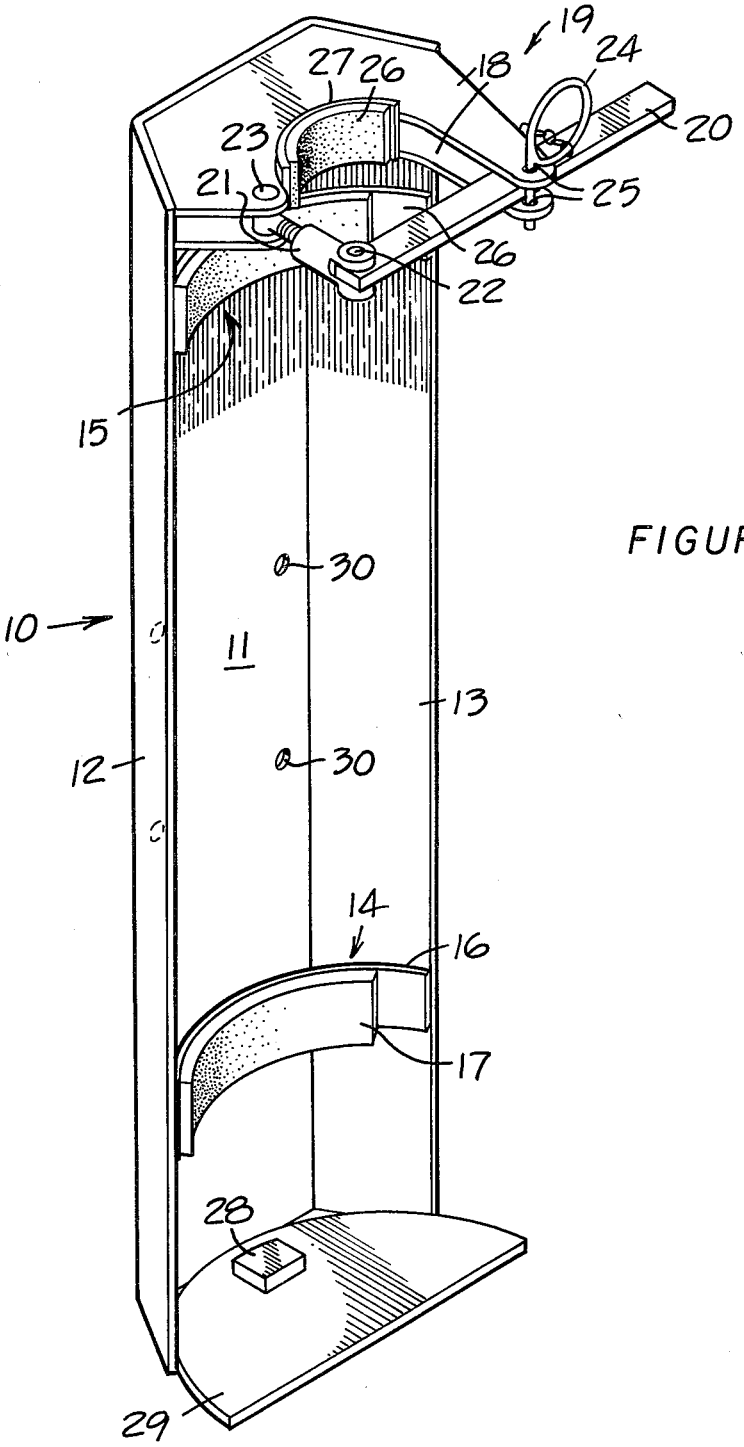
FIG. 1 is a front isometric view of a bracket assembly embodiment of this invention.

FIG. 1 illustrates a bracket assembly comprising a bracket 10 including a back plate 11 and a pair of side plates 12 and 13. A pair of longitudinally spaced and arcuate members 14 and 15 are secured to the plates within a recess defined thereby. As shown in FIGS. 2–4, the recess is adapted to partially retain a tubular article, such as the illustrated tank-type fire extinguisher F therein. Member 14, for example, may comprise a metallic strip 16 welded or otherwise suitable secured to the plates and an elastomeric strip 17 suitable bonded to the metallic strip to prevent damage to the fire extinguisher.

A pair of plates 18 are secured to an upper end of the bracket and have a latch means 19 mounted thereon for releasably retaining the fire extinguisher on the bracket assembly. The latch means may include a lever 20 pivotally mounted on plates 18 by a threadably adjustable link 21, pivotally interconnected between the lever and plates by pivot pins 22 and 23. A key lock 24 may be suitably inserted through aligned apertures 25 formed through plates 18 to retain lever 20 in its illustrated closed position. It should be noted that link 21 is adjustable axially to selectively position pivot pin 22 and lever 20 relative to a neck N of the fire extinguisher (FIG. 3).

In its store position, the neck of the fire extinguisher engages an elastomeric pad 26 which is suitably secured to a back-up plate 27, secured to plates 18. As discussed more fully hereinafter, 26 is preferably composed of an elastomer, such as rubber, which will be compressed by neck N of the fire extinguisher during storage thereof and functions as kick-out means for automatically ejecting the fire extinguisher outwardly from bracket 10 upon release of latch means 19.

As shown in FIGS. 1, 2 and 4, the lower end of the fire extinguisher has an annular rim or lip R formed thereon which normally engages behind a retaining means, such as a lug 28, secured on a plate 29 of the bracket assembly to provide a sufficient clearance of space between the lug and plate 11 to receive the rim. A plurality of holes 30 are formed through back plate 11 of the bracket assembly to adapt it for mounting by cap screws within the operator's cab of a construction vehicle, for example.

INDUSTRIAL APPLICABILITY

As shown in FIGS. 2–4, fire extinguisher F is preferably stored in an upright position on the bracket assembly and retained thereon by latch means 19. Link 21 is suitably preadjusted to position lever 20 so that it clamps neck N of the fire extinguisher against pad 26. The pad is thus compressed under a predetermined force to provide stored energy for ejecting the fire extinguisher from the bracket assembly upon release of latch means 19. In particular, upon removal of key lock 24, pad 26 will expand to eject and pivot fire extinguisher F to its F′ position in FIG. 4.

Simultaneously with such ejection, rim R of the fire extinguisher will automatically release from the retaining means comprising lug 28. The fire extinguisher will pivot about a point P on plate 29 whereby the operator may readily grasp the fire extinguisher. Upon remounting of the fire extinguisher on the bracket ssembly, rim R need only be placed behind lug 28 and latch means 19 return to its illustrated closed position with the key lock being inerted through apertures 25 of plates 18.

Other aspects, objects and advantages of this invention can be obtained from a study of the drawings, the disclosure and the appended claims.

What is claimed is:

1. A bracket assembly adapted to mount a tubular article thereon comprising a bracket (10) comprising a back plate (11) having a bottom plate (29) secured thereto and defining a mounting recess adapted to have an article (F) at least partially disposed therein;

latch means (19), comprising a lever (20) pivotally mounted on an upper end of said bracket (10), for releasably retaining an article thereon, kick-out means, comprising an elastomeric pad (26) having a circumferential length substantially less than 180°, mounted on said bracket (10) for automatically ejecting an article disposed on said bracket outwardly from said bracket upon release of said latch means, said lever (20 extending fully across said kick-out means (26), and retaining means (28) secured on a lower end of said bracket (10) for retaining a lower end of an article on said bracket (10) and for releasing the article upon ejection of the article from said bracket (10) by said kick-out means (26), said retaining means (28) comprising a lug (28) secured on said bottom plate (29) and separated from said back plate (11) to provide a space for the reception of a rim of an article therein.

2. The bracket assembly of claim 1 wherein said bracket further comprises a pair of side plates (12,13) secured to said back plate (11) and at least one arcuate member (14 or 15) secured to at least one of said back (11) and side (12,13) plates, said member (14 or 15) defining a surface adapted to conform to a tubular article mounted of said bracket assembly.

3. The bracket assembly claim 1 further comprising means (21) adjustably mounting said lever (20) on said bracket (10) for selectively positioning said lever (20) relative to said kick-out means (26).

4. The bracket assembly of claim 1 wherein said means (21) adjustably mounting said lever (20) on said bracket (10) comprises an adjustable link (21) pivotally interconnected between said lever (20) and said bracket (10).

5. The bracket assembly of claim 1 wherein said elastomeric pad (26) is arcuate and is secured at an upper end of said bracket to adapt it for engagement with an annular neck of an article.

* * * * *